US006896734B2

(12) United States Patent
Nishioka et al.

(10) Patent No.: US 6,896,734 B2
(45) Date of Patent: May 24, 2005

(54) TRANSFER TOOL AND TRANSFER FILM REMOVER

(75) Inventors: Yasuhiro Nishioka, Osaka (JP); Hiromi Masutomi, Osaka (JP); Mitsuaki Tanaka, Osaka (JP); Kazuki Morimoto, Osaka (JP); Shigeki Akiyama, Osaka (JP); Rie Hamada, Osaka (JP); Shinya Fujii, Osaka (JP); Kayo Tsumura, Osaka (JP); Souichi Taniwaki, Osaka (JP); Shigeru Chuuma, Osaka (JP)

(73) Assignee: Seed Company Limited, Osaka (JP)

( * ) Notice: Subject to any disclaimer, the term of this patent is extended or adjusted under 35 U.S.C. 154(b) by 0 days.

(21) Appl. No.: 10/832,416

(22) Filed: Apr. 27, 2004

(65) Prior Publication Data

US 2005/0082010 A1 Apr. 21, 2005

(30) Foreign Application Priority Data

Oct. 16, 2003 (JP) ..... 2003-356800

(51) Int. Cl.[7] ..... B05C 17/10

(52) U.S. Cl. ..... 118/76; 118/257; 156/577; 156/579; 242/588.3; 242/588.6

(58) Field of Search ..... 118/76, 257; 400/695, 400/697, 698, 700; 156/577, 579; 242/588, 588.3, 588.6, 160.2, 160.4, 170, 171

(56) References Cited

U.S. PATENT DOCUMENTS 6,805,762 B2 * 10/2004 Narita et al. ..... 156/86
6,808,565 B1 * 10/2004 Koyama et al. ..... 118/200
6,830,089 B1 * 12/2004 Tamai et al. ..... 156/577

FOREIGN PATENT DOCUMENTS

JP 09-104562 A1 4/1997

* cited by examiner

*Primary Examiner*—Laura Edwards
(74) *Attorney, Agent, or Firm*—Rader, Fishman & Grauer PLLC

(57) ABSTRACT

A transfer tool having a transfer film remover for abrading and removing various transfer films transferred on a sheet of paper or the like without scratching or staining the paper surface. A transfer film remover for abrading and removing a transfer film transferred on a sheet of paper or the like is provided in part of a case of a transfer tool for transferring coat film or other transfer film on a transfer tape onto a sheet of paper or the like. By the exclusive transfer film remover always furnish in the transfer tool, the transfer film transferred on the transfer area can be abraded and removed, and hence it is not dropped or lost.

30 Claims, 11 Drawing Sheets

PRIOR ART

TRANSFER TOOL AND TRANSFER FILM REMOVER

BACKGROUND OF THE INVENTION

1. Field of the Invention

The present invention relates to a transfer tool and a transfer film remover, and more particularly to a transfer film removing technology for abrading and removing a transfer film once transferred on a sheet of paper or the like, in a transfer tool for transferring a coat film, transfer mark or other transfer film formed on a transfer tape onto a sheet of paper or the like.

2. Description of the Related Art

In this kind of transfer tool, generally, a transfer head is projected outward from an insert opening at the leading end of a case, and a transfer tape is paid off from a payoff reel installed in the case, and taken up and collected on a take-up reel in the case again by way of the leading end pressing part of the transfer head, and the case further incorporates a gear mechanism and an interlock mechanism for rotating the payoff reel and take-up reel in cooperation, and a clutch mechanism for synchronizing the payoff speed and take-up speed of the transfer tape between the payoff reel and take-up reel (see, for example, Japanese Laid-open Patent No. H9-104562).

As shown in FIG. 11, a case 2 of a transfer tool 1 is gripped by fingers, and a leading end pressing part 4*a* of a transfer head 4 is pressed tightly on a transfer area 11, and the case 2 is moved along the surface of the transfer area 11 in this state, and stopped. As a result, a transfer film 10 on a transfer tape 3 paid off from a payoff reel (not shown) in the case 2 is transferred on the transfer area 11 by the transfer head 4, and the used transfer tape 3 is taken up and collected on a take-up reel (not shown) in the case 2.

It may be sometimes desired to remove the transfer film 10 once transferred on the transfer area 11 by the transfer tool 1.

In such a case, hitherto, no special remover has been known, and it is removed by using an ordinary eraser or cutter knife, but it is not convenient to carry such eraser always together with the transfer tool, or it may be dropped or lost.

The transfer film 10 is available in various forms, including correction coat film for covering and concealing letters, marker coat film for emphasizing letters, adhesive coat film used as adhesive, other coat films, and thin film transfer mark of letters, symbols, graphic patterns or their combination, and constituent materials for such transfer films 10 are also varied.

Accordingly, if the transfer film 10 is abraded by an ordinary eraser, the transfer film 10 may not be easily removed (abrasive removal), or if removed, the surface of the transfer area 11 such as sheet of paper may be scratched or stained. The latter inconvenience is also caused by cutter knife.

BRIEF SUMMARY OF THE INVENTION

It is hence a primary object of the invention to present a novel transfer film remover solving the problems of the prior art.

It is other object of the invention to present a transfer film remover capable of abrading and removing various transfer films once transferred on the sheet of paper by the transfer tool easily and securely without scratching or staining the sheet of paper.

It is another object of the invention to present a transfer tool comprising such transfer film remover.

The transfer tool of the invention is a transfer tool for transferring coat film or transfer mark on transfer tape on a sheet of paper, comprising at least a hand-held case to be manipulated by one hand, a payoff reel rotatably installed in the case and winding a transfer tape so as to be paid off, and a transfer head disposed at the leading end of the case for pressing and transferring the transfer tape paid off from the payoff reel onto a transfer area, in which a transfer film remover is provided in part of the case for abrading and removing the transfer film transferred on a sheet of paper.

A preferred embodiment is for transferring coat film or transfer mark on transfer tape on a sheet of paper, comprising the hand-held case to be manipulated by one hand, the payoff reel rotatably installed in the case and winding a transfer tape so as to be paid off, a take-up reel rotatably installed in the case for taking up and collecting the used transfer tape, an interlock mechanism for rotating the take-up reel and payoff reel mutually in cooperation, a transfer head disposed at the leading end of the case for pressing and transferring the transfer tape paid off from the payoff reel onto a transfer area, and a clutch mechanism for synchronizing the payoff speed and take-up speed of the transfer tape between the payoff reel and take-up reel, in which the transfer film remover is provided in part of the case for abrading and removing the transfer film transferred on a sheet of paper.

The position of the case comprising the transfer film remover is ergonomically set at a position proper for holding and manipulating by a hand when abrading and removing the by pressing this transfer film remover to the transfer film transferred on a sheet of paper or the like. The transfer film remover has an appearance and shape having a corner of shape and dimension capable of abrading and removing a specific part of the transfer film in its part.

The constitution of the transfer film remover of the invention is intended to abrade and remove the transfer film transferred on a sheet of paper by the transfer tool, and it is composed of a material small in wear when abrading and removing the transfer film transferred on the sheet of paper, and specifically it is composed of a material not worn substantially at least within the life span of the transfer tool, or a material not changed in surface properties substantially at least within the life span of the transfer tool.

In a preferred embodiment, the transfer film remover includes at least one of resin component and rubber component.

As the resin component, thermoplastic elastomer is preferably used, and the thermoplastic elastomer includes at least one of styrene derivative thermoplastic elastomer and olefin derivative elastomer.

The styrene derivative thermoplastic elastomer includes at least one of styrene-butadiene-styrene copolymer, styrene-isoprene-styrene copolymer, styrene-ethylene butylene-styrene copolymer, styrene-ethylene propylene-styrene copolymer, and styrene-ethylene ethylene propylene-styrene copolymer. The olefin derivative elastomer includes at least one of olefin derivative thermoplastic elastomer, ethylene-α-olefin copolymer, propylene-α-olefin copolymer, ethylene-α-olefin copolymer (metallocene catalyst), amorphouspoly-α-olefin, high density polyethylene, low density polyethylene, ultra-low density polyethylene, and polypropylene.

The rubber component may include at least one of butyl rubber, isoprene rubber, styrene butadiene rubber, butadiene rubber, ethylene propylene rubber, ethylene propylene terpolymer, acrylic rubber, polyisoprene, and natural rubber, or it may also have a core-shell structure.

When the transfer film remover contains the resin component and rubber component, the ratio of resin component and rubber component by weight is preferred to be set in a range of 25:75 to 75:25.

In the transfer tool of the invention, by gripping the case of the transfer tool by fingers, and moving along the surface of the transfer area with the leading end pressing part of the transfer head tightly pressed onto the transfer area, the transfer film on the transfer tape paid off from the payoff reel in the case is transferred on the transfer area by the transfer head, and the used transfer tape is taken up and collected on the take-up reel in the case.

When desired to remove the transfer film once transferred on the transfer area, the transfer film is abraded and removed by using the transfer film remover provided in part of the case.

According to the transfer tool of the invention, since the transfer film remover for abrading and removing the transfer film transferred on the sheet of paper is provided in part of the case, by the exclusive transfer film remover always furnished in the transfer tool, the transfer film once transferred on the transfer area can be abraded and removed, and there is no risk of dropping and losing.

The position of the case comprising the transfer film remover is ergonomically set at a position proper for holding and manipulating by a hand when abrading and removing the by pressing this transfer film remover to the transfer film transferred on a sheet of paper or the like, so that the transfer film can be abraded and removed easily and securely.

The transfer film remover has an appearance and shape having a corner of shape and dimension capable of abrading and removing a small part of the transfer film in its part, and therefore not only the whole transfer film but also a small part thereof can be abraded and removed.

The transfer film remover of the invention is composed of a material small in wear when abrading and removing the transfer film transferred on the sheet of paper, and therefore various transfer films once transferred on the sheet of paper by the transfer tool can be abraded and removed easily and securely without scratching or staining the sheet of paper.

Further, since the transfer film remover is composed of a material of small wear, and when it is provided in part of the case of the transfer tool of the invention, it is almost free from wear in the time course as compared with the life span of the transfer tool itself, and the appearance of the transfer tool is not spoiled by wear and deformation of the transfer film remover.

These and other objects and features of the invention will be more clearly by reading the detailed description on the basis of the accompanying drawings and novel facts disclosed in the claims.

DETAILED DESCRIPTION OF THE PREFERRED EMBODIMENTS

Figure 1A:
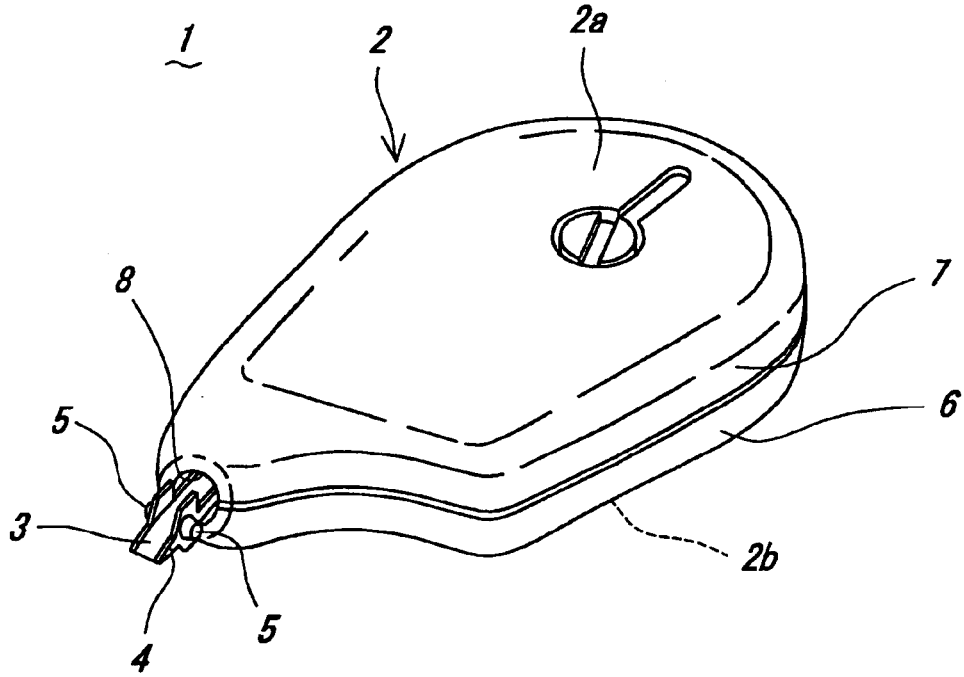
FIG. 1A is a perspective view showing an entire appearance of transfer tool in preferred-embodiment 1 of the invention.

Preferred embodiments of the invention are described below while referring to the accompanying drawings.

FIG. 1 to FIG. 10 show the transfer tool and transfer film remover of the invention, and same reference numerals throughout the drawings indicate same constituent members or elements.

Preferred Embodiment 1

Figure 1B:
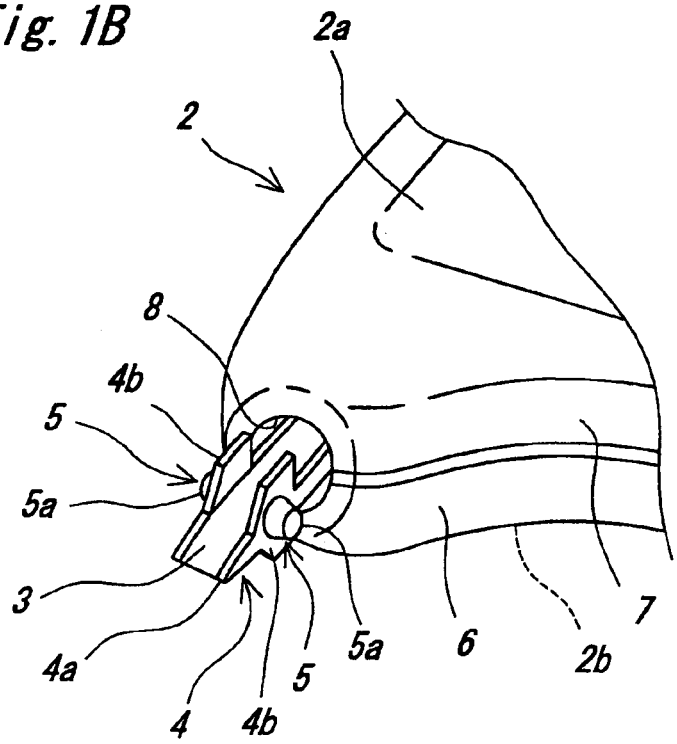
FIG. 1B is a perspective view magnifying essential parts of the transfer tool.

The transfer tool of the invention is shown in FIG. 1A and FIG. 1B, and this transfer tool 1 is specifically a transfer tool for transferring a coat film, transfer mark or other transfer film on a transfer tape on a sheet of paper, and in the illustrated example it is used as an eraser for correcting a wrong letter or the like.

The eraser 1 is a disposable type of which components including the transfer tape are all consumable, and its basic structure is known. That is, although not specifically shown in the drawing, the eraser 1 comprises principal components such as a payoff reel winding a transfer tape 3 to be paid off, a take-up reel for taking up and collecting the used transfer tape, an interlock mechanism for rotating these reels mutually in cooperation, a transfer head 4 for pressing and transferring the transfer tape 3 on a transfer area, and a clutch mechanism for synchronizing the payoff speed and take-up speed of the transfer tape 3 of the two reels, which are provided in a case 2 having an appearance and shape as shown in the drawing, and a transfer film remover 5 for abrading and removing the transfer film transferred on a sheet of paper or the like is provided also in part of the case 2.

The case 2 can be held and manipulated by one hand, and is a flat box, as shown in the drawing, having front contour shape and dimension and width dimension enough to incorporate constituent parts such as the payoff reel and take-up reel, and a pair of flat mutually confronting face and back sides 2*a*, 2*b* are standard gripping sides when held and manipulated by hand.

This case 2 is a integral plastic structure formed by injection molding, and is composed of a case main body 6 and a cap body 7 in split structure, and a head insertion opening 8 inserting inside and outside of the transfer head 4 is formed at the leading end of the case 2.

The transfer tape 3 has a conventionally known laminate structure, and specifically, on one side of a film base tape, a peelant layer, a correction paint layer, and an adhesive (pressure sensitive adhesive) layer having pressure adhesiveness are sequentially laminated, and the correction paint layer and adhesive layer form a correction coat film 10 (see FIG. 11) as transfer film.

The transfer tape 3 paid off from the payoff reel in the case 2 is guided to a leading end pressing part 4*a* along the tape running surface at one side of the transfer head 4, and is inverted after the leading end pressing part 4*a*, and is further guided along the tape running surface at the opposite side, and is taken up on the take-up reel in the case 2.

A transfer film remover 5 is intended to abrade and remove the correction coat film (transfer film) 10 once transferred to the sheet of paper, and it is made of a material small in wear when abrading and removing the transfer film transferred on the sheet of paper.

Figure 2A:
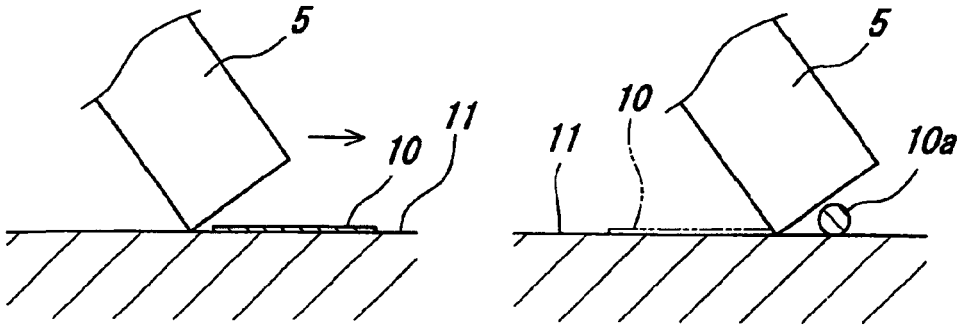
FIG. 2A is a schematic diagram explaining abrasive removal mechanism in abrading and removing operation of transfer film remover of the transfer tool.

In other words, the transfer film remover 5 is composed of a material having an abrasive removal mechanism, as schematically shown in FIG. 2A, for pressing and abrading off (abrading and removing) the correction coat film 10 transferred on the transfer area 11 of sheet of paper by the coat film remover 5 by scraping off only the correction coat film 10 from the surface of the transfer area 11, leaving only the scraped coat film waste 10*a*, while the transfer film remover 5 is not substantially worn. In this case, too, by the abrasive removal motion of the transfer film remover 5, it is required to have a certain elasticity so that the surface of the transfer area 11 may not be scratched.

Such required conditions of the coat film transfer remover 5 are mainly based on the following reasons.

(a) The correction coat film (transfer film) 10 can be abraded and removed easily and securely without scratching or staining the surface of the transfer area 11 or the sheet of paper.

(b) Considering that the transfer film remover 5 forms part of the appearance of the transfer tool 1, the transfer film remover 5 is not worn throughout the life span of the transfer tool 1 (the life of the transfer tape 3 in the disposable type as in this preferred embodiment), and the appearance of the transfer tool 1 is not impaired by wear or deformation of the transfer film remover 5. Specifically, the transfer film remover 5 is substantially free from wear at least within the life span of the transfer tool 1, or at least there is no change in surface properties substantially within the life span of the transfer tool.

Figure 2B:
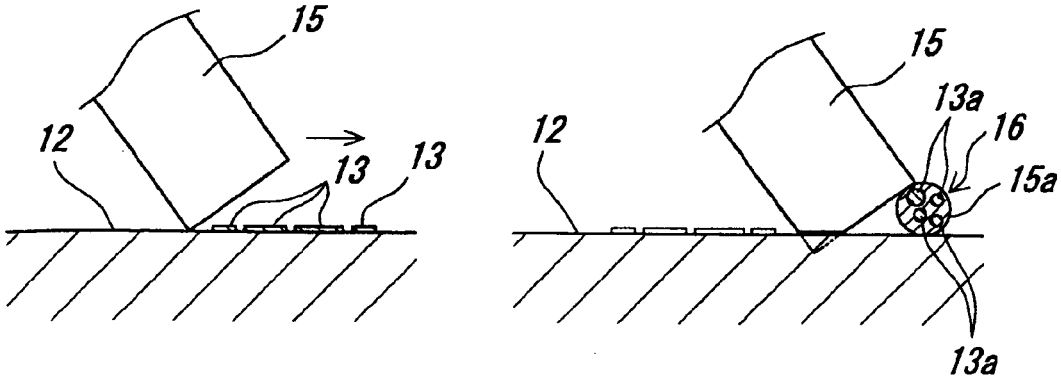
FIG. 2B is a schematic diagram showing abrasive removal mechanism of a conventional known plastic eraser.

On the other hand, in an ordinary eraser, for example, in an abrasive removal mechanism of letter written by pencil by a plastic eraser, as schematically shown in FIG. 2B, a letter 13 written by a pencil on a sheet of paper 12 is pressed and scraped (abraded and removed) by a plastic eraser 15, and then pencil lead materials 13*a*, 13*a*, . . . composing the letter 13 scraped off from the sheet of paper 12, and worn waste 15*a* from the plastic eraser 15 are mixed, and erasing waste 16 is produced.

The constituent material of the transfer film remover 5 contains at least one of resin component and rubber component.

As the resin component, thermoplastic elastomer is preferred, and especially styrene derivative and olefin derivative thermoplastic elastomers are preferably used, and they can be used either alone or in combination of two or more type, and in particular styrene derivative thermoplastic elastomer is preferred.

A general composition of thermoplastic elastomer comprises a soft layer (soft segment) and hard layer (hard segment). The soft layer and hard layer are combined to produce an original rubber elasticity of thermoplastic elastomer, and in the molding process, the hard layer is fused and plasticized to express a molding processability, and is cured after molding, thereby expressing a mechanism of restraint component for preventing plastic deformation.

Examples of styrene derivative thermoplastic elastomer include styrene-butadiene-styrene copolymer, styrene-isoprene-styrene copolymer, styrene-ethylene butylene-styrene copolymer, styrene-ethylene propylene-styrene copolymer, styrene-ethylene ethylene propylene-styrene copolymer, and styrene derivative thermoplastic elastomer compound, which may be used either alone or in combination of two or more kinds. Examples of commercial products of styrene derivative thermoplastic elastomer are listed below.

The styrene-butadiene-styrene copolymer includes Tuffprene (A, 125, 126, etc.) and Asaprene T (411, 414, 475, etc. (both of Asahi Chemical) and Crayton D (1101, 1102, etc.) (of Crayton Polymer Japan).

The styrene-isoprene-styrene copolymer includes Crayton D (1107, 1111, etc.) (of Crayton Polymer Japan).

The styrene-ethylene butylene-styrene copolymer includes Tufftech H (1031, 1041, etc.) (of Asahi Chemical), Septon (8004, 8006, etc.) (of Kuraray), and Crayton G (1605, 1651, etc.) (of Crayton Polymer Japan).

The styrene-ethylene propylene-styrene copolymer includes Septon (2002, 2005, etc.) (of Kuraray), and Crayton G1730 (of Crayton Polymer Japan).

The styrene-ethylene ethylene propylene-styrene copolymer includes Septon 4033 (of Kuraray).

Examples of the olefin derivative elastomer include olefin derivative thermoplastic elastomer, ethylene-α-olefin copolymer, propylene-α-olefin copolymer, ethylene-α-olefin copolymer (metallocene catalyst), amorphous poly-α-olefin, high density polyethylene, low density polyethylene, ultra-low density polyethylene, and polypropylene, which may be used either alone or in combination of two or more kinds.

Examples of commercial products of olefin derivative elastomer include Sumitomo TPE (820, 821, 5260, etc.) (of Sumitomo Chemical), Idemitsu TPO (R110E, M142E, etc.) (of Idemitsu Oil), and Milastomer (5030, 8030, etc.) (of Mitsui Chemical).

The rubber component may include IIR (butyl rubber), IR (isoprene rubber), SBR (styrene butadiene rubber), BR (butadiene rubber), EPM (ethylene propylene rubber) EPDM (ethylene propylene terpolymer), ACM (acrylic rubber), polyisobutylene, and NR (natural-rubber), which may be used either alone or in combination of two or more kinds.

The rubber component may also have a core-shell structure. The rubber component of core-shell structure has a structure composed of core portion and shell portion, and the core portion and shell portion differ in composition. By such core-shell structure of rubber component of polymer material, various merits are brought about, for example, (i) the glass transition temperature (Tg) can be controlled by combination of high Tg and low Tg materials, (ii) compatibility or adhesion to other material can be adjusted by varying the resin of the shell portion, and (iii) the viscoelasticity can be controlled by combination of high viscosity and low viscosity materials.

Examples of commercial products of rubber component are listed below.

The IIR (butyl rubber) includes Exxon butyl (065, 268, etc.) (of Exxon Mobil), and Bayer butyl (100, 301, etc.) (of Bayer).

The IR includes JSR IR2200 (of JSR).

The SBR includes JSR (1500, 0202, SL552, etc.) (of JSR) and Nipol (1502, NS210, etc.) (of Zeon Japan).

The BR includes JSR (BR01, T700, etc.) (of JSR), and Nipol (BR220, BR12:41, etc.) (of Zeon Japan).

The EPM includes JSR EP11 (of JSR).

The EPDM includes JSR EP21, EP24 (of JSR).

The ACM includes Nipol (AR31, AR51, AR71, AR71L, AR32, AR42W, AR72LS, AR72HF, AR53L, AR12, AR54, AR74X, AR14) (of Zeon Japan) and Paraclon (SN-50, AX-2, EM-AX-2, AS-3000, ME-3500, W-248, W-197C, etc.) (of Negami Kogyo).

Examples of the ACM as rubber component having core-shell structure include Paraclon (RP-101, RP-103, RP-301, RP-302, RP-303, PR-412) (of Negami Kogyo), and Parapet (GR-04940, GR-04970, GR-01240, GR-01270, G-1000, HR-L, SA-FW001, SA-FW101, SA-NW001, SA-NW2001, SA-CW001, SA-1000NP, SA-1000CP) (of Kuraray).

A specific constituent material for the transfer film remover 5 may include anyone of the resin components and rubber components stated above, a mixed material of them, or a single material or mixed material blended with additives properly selected from known materials generally used as additives in plastic processing or rubber processing (for example, filler, softener, lubricant, stabilizer, aging retardant, coloring matter, etc.).

When the transfer film remover contains both resin component and rubber component, the ratio of resin component and rubber component by weight is preferred to be set in a range of 25:75 to 75:25.

The location of the transfer film remover 5 in the case 2 is ergonomically set at a position proper for holding and manipulating the case 2 by hand when abrading and removing by pressing this transfer film remover 5 to the correction coat film (transfer film) 10 transferred on the sheet of paper.

In other words, as in FIG. 2A, when the transfer film remover 5 is pressed against the correction coat film 10 transferred on the transfer area 11 for abrading and removing, the user can grip the case 2 in natural position by the fingers of one hand, and the case 2 can be manipulated in abrasive removal operation without requiring extra effort.

The transfer film remover 5 in the illustrated preferred embodiment is provided integrally, projecting to both sides of the transfer head 4 projecting from the leading end of the case 2, that is, sideward to the outer side of guide flanges 4*b*, 4*b* for guiding running of the transfer tape 3, and same manipulation as in transfer manipulation of the transfer tape 3 is assured.

Since this transfer film remover 5 is formed simultaneously with the transfer head 4, the transfer head 4 is also required to have a certain elasticity (such an elasticity as to allow elastic deformation in the pressing direction of the transfer tape 3 in pressing transfer action), and as far as the above condition is satisfied, the transfer head 4 and transfer film remover 5 may be made of a same constituent material. Thus, when the transfer head 4 and transfer film remover 5 are made of same material, the both can be formed integrally by injection molding.

The transfer film remover 5 is preferred to have a corner 5*a* in part of its appearance, and the transfer film remover 5 in the illustrated preferred embodiment is a truncated conical form, and the edge of the leading end forms a corner 5*a*. The shape and size of the corner 5*a* may be set to such an extent as to abrade and remove a small part of the correction coat film 10. By moving the transfer film remover 5 in a direction along the edge of the truncated conical form composing the corner 5*a*, only a small part of the correction coat film 10 can be removed by abrading, and by moving the transfer film remover 5 in a direction intersecting the edge of the truncated conical form, a wide range or whole of the correction coat film 10 can be efficiently removed by abrading.

Figure 11:
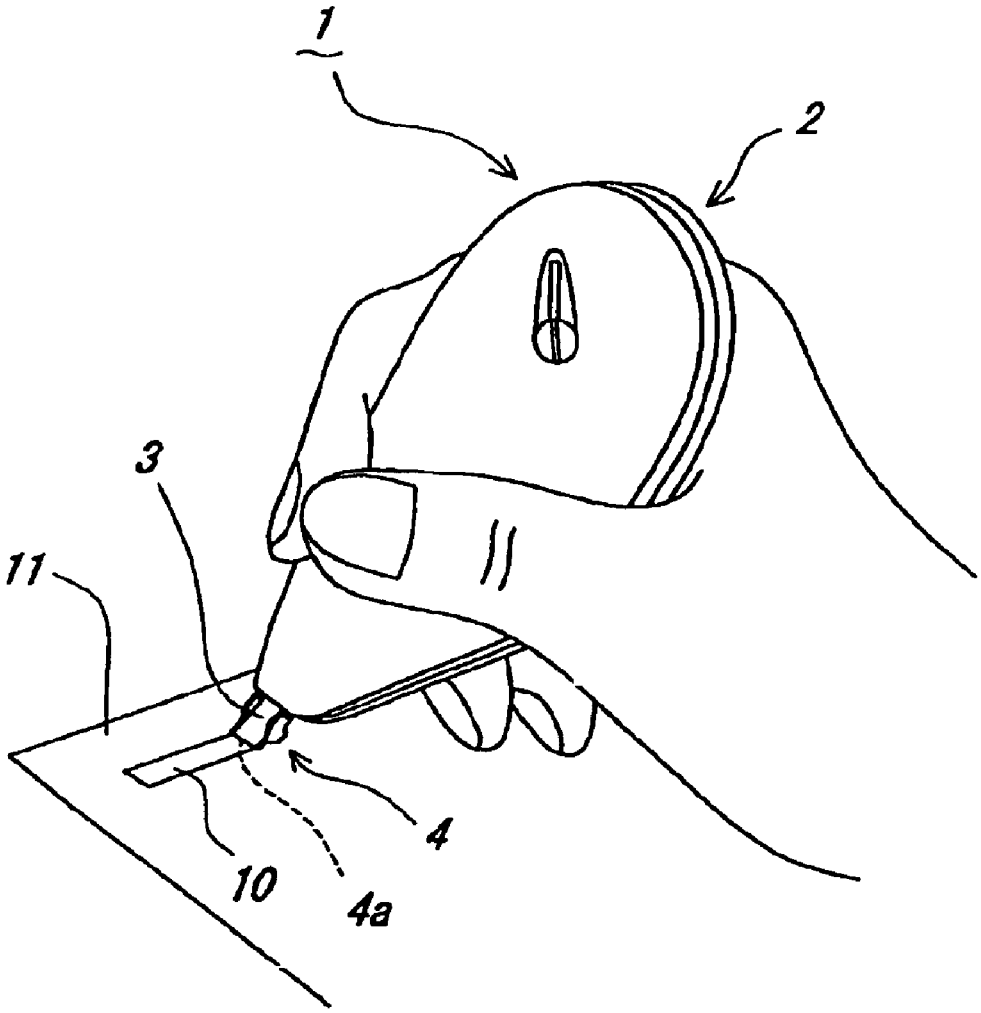
FIG. 11 is a perspective view showing a general state of use of transfer tool.

Thus, to correct a wrong letter by the transfer tool 1 having such structure, as shown in FIG. 11, the gripping faces 2*a*, 2*b* of the case 2 are held by fingers, and the leading end pressing part 4*a* of the transfer head 4 is tightly pressed on the transfer area 11 such as the sheet of paper, and by moving the case 2 in this state along the surface of the transfer area 11, the correction coat film 10 of the transfer tape 3 at the leading end pressing part 4*a* of the transfer head 4 is peeled from the base tape and transferred on the correction area 11, and the used transfer tape after the correction coat film 10 is peeled, that is, the bas tape is taken up and collected on the take-up reel in the case 2.

When desired to remove the correction coat film 10 once transferred on the transfer area 11, the correction coat film 10 is abraded and removed by using the transfer film remover 5 provided in the transfer head 4 of the case 2.

In this case, since the transfer film remover 5 is provided integrally in the transfer head 4 of the case 2, it is always furnished in the transfer tool 1 and is not dropped or lost.

Since the location of the case 2 comprising the transfer film remover 5 is ergonomically set at a position proper for holding and manipulating the case 2 by hand when abrading and removing by pressing this transfer film remover 5 to the correction coat film 10 transferred on the transfer area 11, it is easy and secure to abrade and remove the correction coat film 10.

The appearance of the transfer film remover 5 is a truncated conical form, having a corner 5*a* of proper shape and size for abrading and removing a small part of the correction coat film 10 in its part, and therefore not only the whole correction coat film 10 but also a small part of it can be abraded and removed.

Further, since the transfer film remover 5 is made of a material of less wear when abrading and removing the transfer film transferred on the sheet of paper, the correction coat film 10 once transferred on the transfer area 11 such as sheet of paper by the transfer tool 1 can be abraded and removed easily and securely without scratching or staining the sheet of paper.

Besides, since the transfer film remover 5 is made of a material of less wear, it is hardly worn throughout the life span of the transfer tool 1 itself, and the appearance of the transfer tool 1 is not spoiled.

Preferred Embodiment 2

Figure 3A:
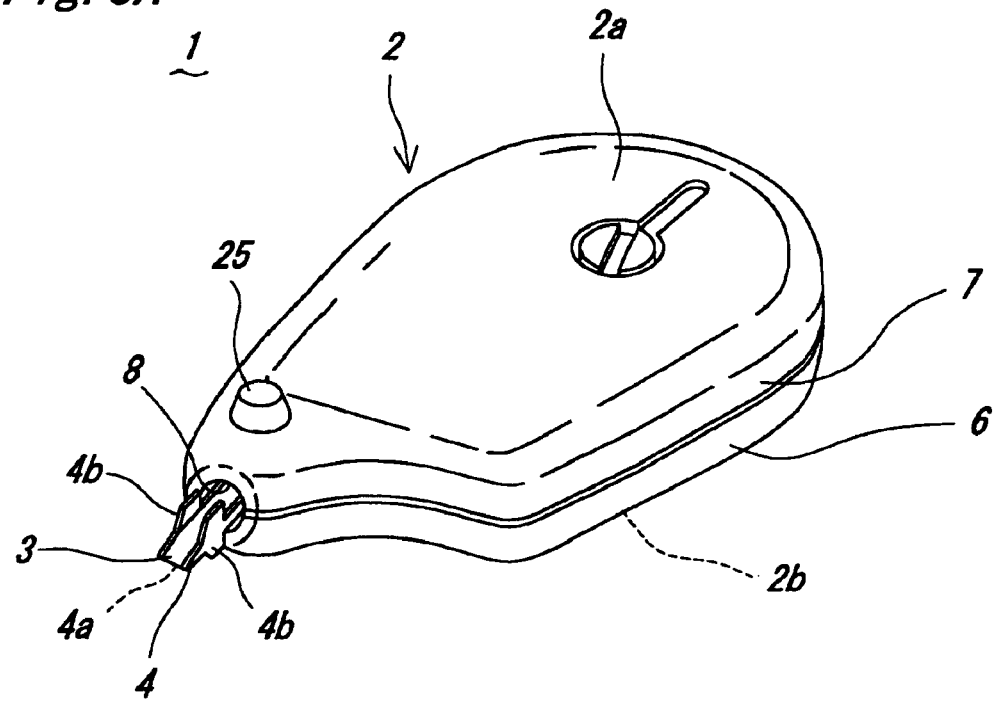
FIG. 3A is a perspective view showing an entire appearance of transfer tool in preferred embodiment 2 of the invention.
Figure 3B:
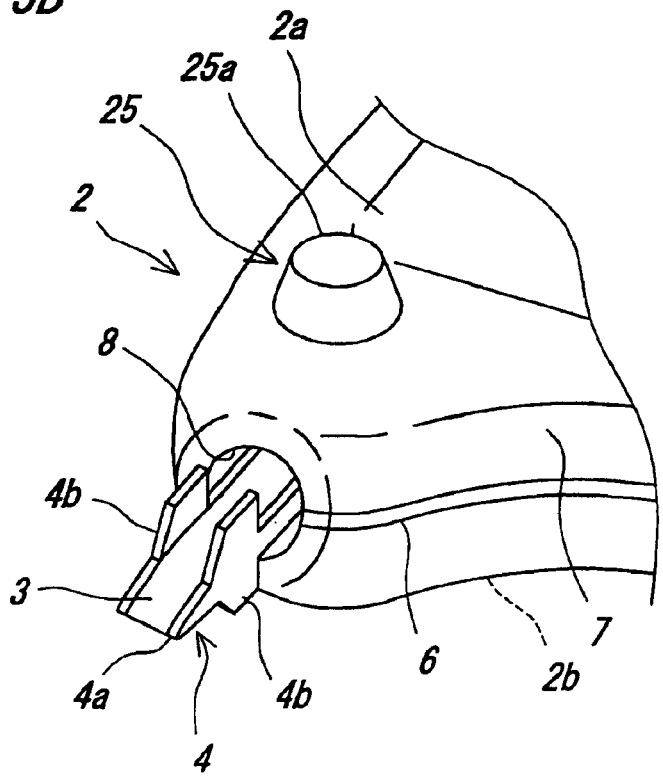
FIG. 3B is a perspective view magnifying essential parts of the transfer tool.

This preferred embodiment is shown in FIG. 3A and FIG. 3B, which is similar to preferred embodiment 1 except that the forming position of the transfer film remover 5 is modified.

That is, the transfer film remover 25 of the preferred embodiment is provided integrally on the leading end surface of the case 2. Specifically, the transfer film remover 25 of the preferred embodiment is provided integrally, projecting to both sides of the leading end of the case 2, that is, sideward to the gripping faces 2*a*, 2*b*.

In such configuration, when pressing the transfer film remover 25 to the correction coat film 10 transferred on the sheet of paper for abrading and removing, the case 2 can be held and manipulated by hand ergonomically, and nearly same sense of manipulation is assured in transfer manipulation of the transfer tape 3, same as experienced in preferred embodiment 1.

The outline shape of the transfer film remover 25 is same as in preferred embodiment 1, specifically a truncated conical form of a similar form to preferred embodiment 1, and the leading end edge 25*a* forms a corner for abrading and removing a small part of the correction coat film 10.

The other constitution and action are same as in preferred embodiment 1.

Preferred Embodiment 3

Figure 4A:
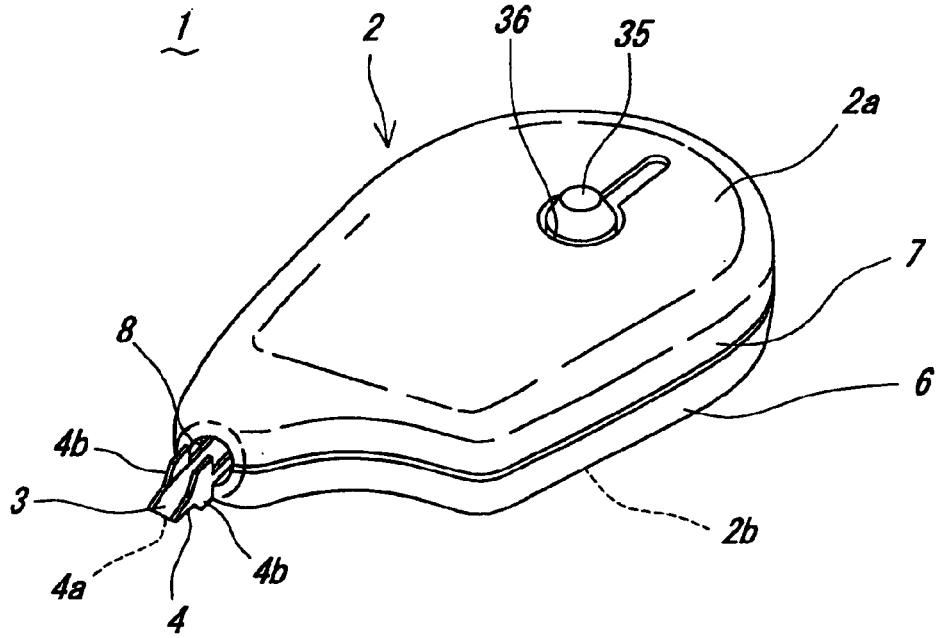
FIG. 4A is a perspective view showing an entire appearance of transfer tool in preferred embodiment 3 of the invention.
Figure 4B:
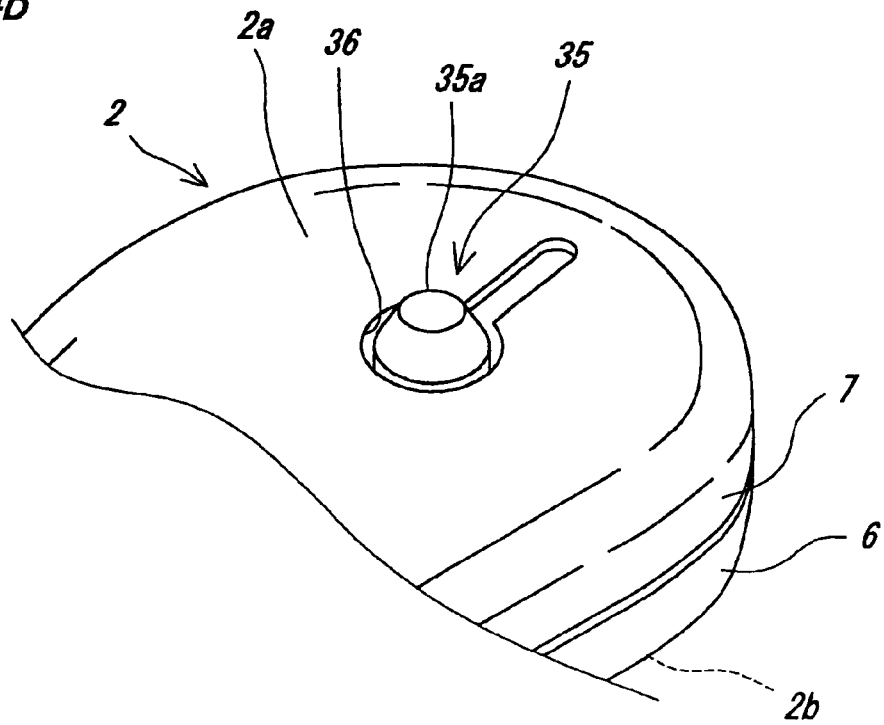
FIG. 4B is a perspective view magnifying essential parts of the transfer tool.

This preferred embodiment is shown in FIG. 4A and FIG. 4B, which is similar to preferred embodiment 1 except that the forming position of the transfer film remover 5 is modified.

That is, the transfer film remover 35 of the preferred embodiment is formed like a rewind button for rewinding the transfer tape 3 provided opposite to the outside of the case 2. Although not shown in the drawing, at one end of rotary support shaft of payoff reel winding the transfer tape 3 provided in the case 2, the transfer film remover 35 having a function of rewind button is integrally provided, and it projects oppositely to the outside from an insert hole 36 of the case 2.

The outline shape of the transfer film remover 35 is same as in preferred embodiment 1, specifically a truncated conical form of a similar form to preferred embodiment 1, and aside from the property of rotation and manipulation as rewind button, the leading end edge 35*a* forms a corner for abrading and removing a small part of the correction coat film 10.

The transfer film remover 35 is formed separately from the support shaft of the payoff reel, and is detachably engaged with the support shaft, but it may be made of same material as the support shaft and formed integrally as far as the required conditions as the constituent material for the transfer film remover mentioned above are satisfied.

In the transfer tool 1 having such structure, when pressing the transfer film remover 35 to the correction coat-film 10 transferred on the sheet of paper for abrading and removing, by gripping a proper position of the case 2, nearly same manipulation as in transfer and manipulation of the transfer tape 3 is assured.

The other constitution and action are same as in preferred embodiment 1.

Preferred Embodiment 4

Figure 5A:
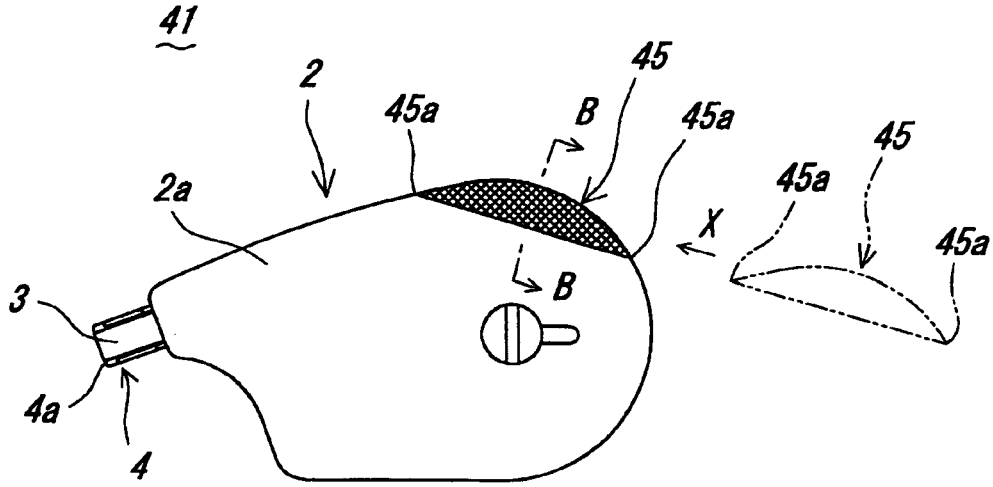
FIG. 5A is a front view showing an entire appearance of transfer tool in preferred embodiment 4 of the invention.
Figure 5B:
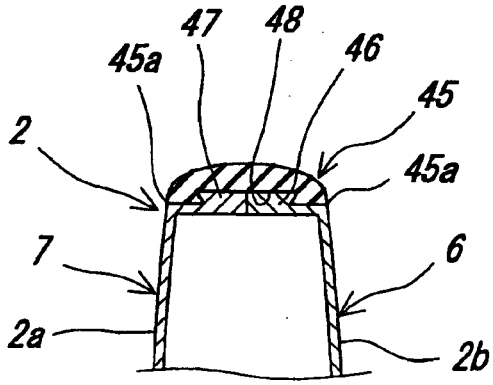
FIG. 5B is a sectional view along line B—B in FIG. 5A showing essential parts of the transfer tool.

This preferred embodiment is shown in FIG. 5A and FIG. 5B, which is similar to preferred embodiment 1 except that the basic structure of the transfer tool 1 and structure of the transfer film remover 5 are modified.

That is, the transfer tool 1 of preferred embodiment 1 is a disposable type, while the transfer tool 41 of the preferred embodiment is a refill type, in which a cartridge at least comprising the payoff reel and take-up reel is detachably provided in the case 2 so as to be exchanged, and the transfer tape 3 can be exchanged, and accordingly, a transfer film remover 45 for abrading and removing the transfer film transferred on the sheet of paper is formed as a case component member for composing a part of the case 2.

The transfer film remover 45 is specifically composed as shown in FIG. 5A, in which part of the outside of the case 2 is formed as fixing members for assembling and fixing the case main body 6 and cap body 7 as component members of the case 2, and is detachable from the case 2.

That is, as shown in FIG. 5B, joining parts 46, 47 of the case main body 6 and cap body 7 are closely engaged with each other, and a dovetail section is formed, and an engaging groove 48 formed in the bottom of the transfer film remover 45 is formed as dovetail groove.

By sliding and fixing the transfer film remover 45 in the joining parts 46, 47 in the X-direction in FIG. 5A (in the vertical direction to the sheet of paper in FIG. 5B), the both joining parts 46, 47 are tightened and fixed from both sides in hugging position.

The constituent material of the transfer film remover 45 is same as in the transfer film remover 5 in preferred embodiment 1.

In the transfer tool 1 having such structure, the transfer film remover 45 is detached from the case 2 when replacing the inside transfer tape 3 by opening the case 2, and also as shown in FIG. 2A, when removing the correction coat film 10 once transferred on the transfer area 11, it can be also detached from the case 2 and used independently. When removing the correction coat film 10 without detaching the transfer film remover 45 from the case 2, the case 2 itself may function as the gripping manipulation part when removing the transfer film.

In this case, an outer peripheral edge 45*a* of the transfer film remover 45 functions as a corner of proper shape and size for abrading and removing a small part of the correction coat film 10, not only the whole correction coat film 10 but also a small part of it can be abraded and removed.

The other constitution and action are same as in preferred embodiment 1.

Preferred Embodiment 5

Figure 6A:
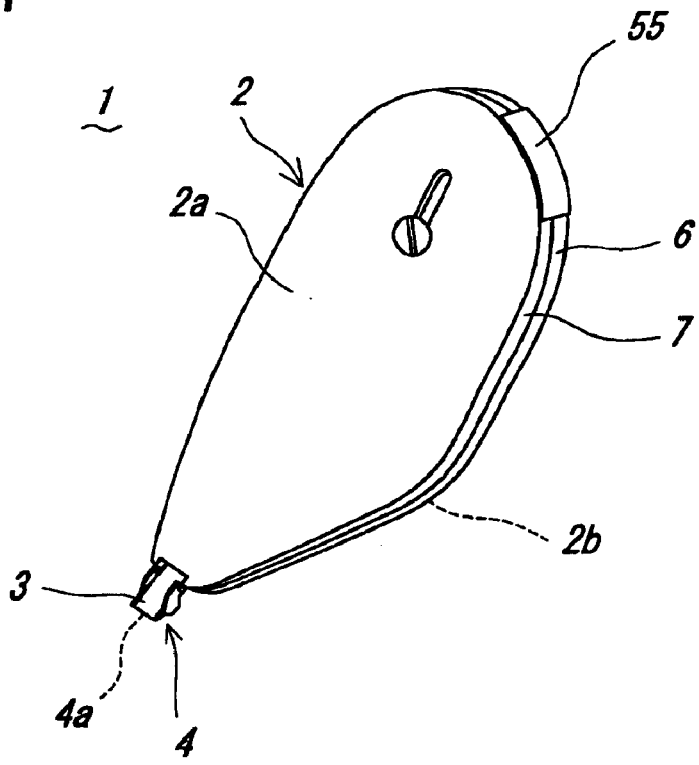
FIG. 6A is a perspective view showing an entire appearance of transfer tool in preferred embodiment 5 of the invention.
Figure 6B:
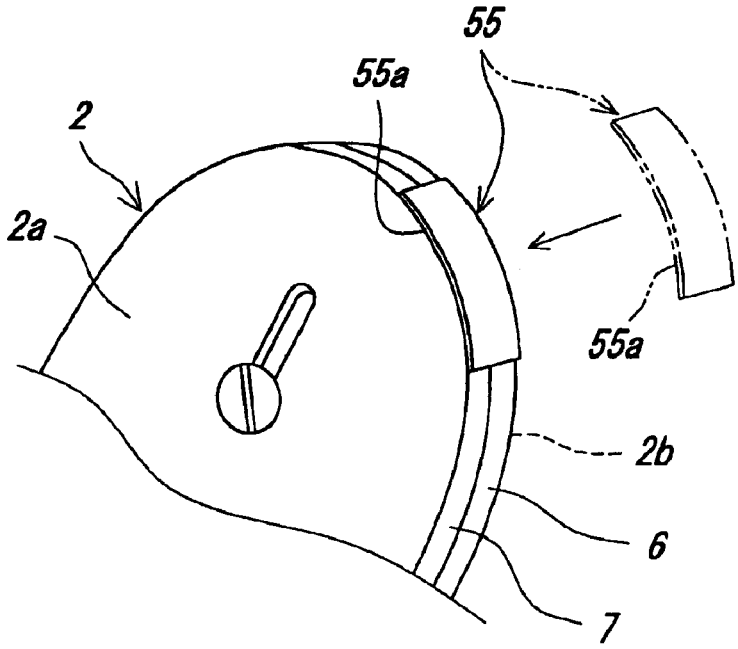
FIG. 6B is a perspective view magnifying essential parts of the transfer tool.

This preferred embodiment is shown in FIG. 6A and FIG. 6B, which is similar to preferred embodiment 1 except that the structure of the transfer film remover 5 is modified.

That is, the transfer film remover 55 of the preferred embodiment is formed as a transfer film removal seal adhered to the surface of the case 2. Specifically, as shown in FIG. 6B, the transfer film remover 55 is formed as an elastic sheet, and an adhesive layer 55*a* is laminated on the entire back side, and it is tightly adhered along the rear end side surface of the case 2 through the adhesive layer 55*a*.

The material of the transfer film remover 55 is same as in the transfer film remover 5 in preferred embodiment 1.

In the transfer tool 1 having such structure, when pressing the transfer film remover 55 to the correction coat film 10 transferred on the sheet of paper for abrading and removing, by gripping a proper position of the case 2 by fingers, the sense of manipulation is nearly same as in transfer manipulation of the transfer tape 3. That is, although not shown specifically in the drawing, the holding manner of the case 2 is a front and rear inverted state of holding in transfer manipulation of the correction coat film 10.

The other constitution and action are same as in preferred embodiment 1.

Preferred Embodiment 6

Figure 7A:
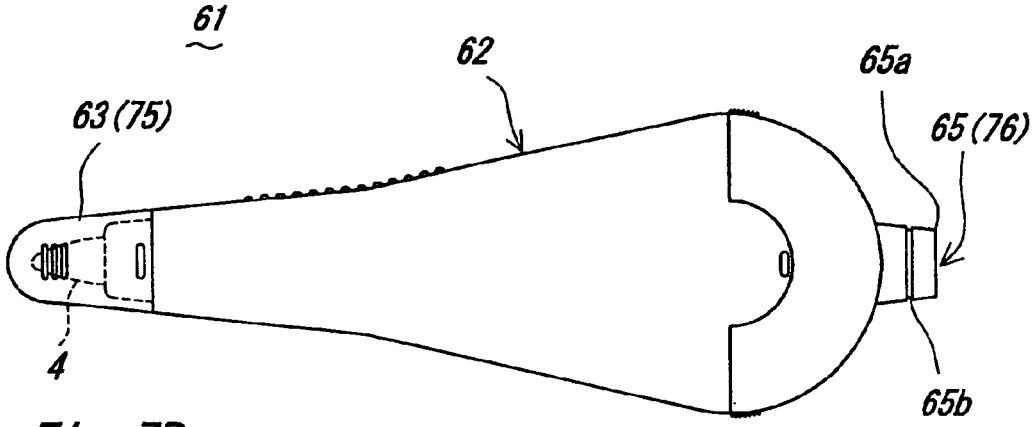
FIG. 7A is a front view of transfer tool in preferred embodiment 6 of the invention in the state of not using or removing the transfer film.
Figure 7B:
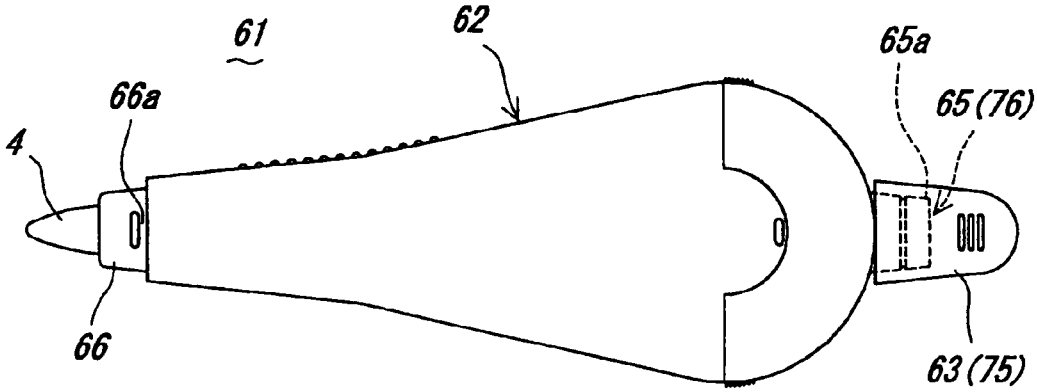
FIG. 7B is a front view showing the state of using the transfer tool.
Figure 7C:
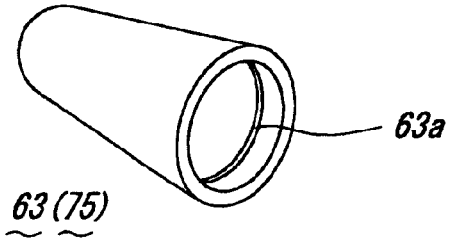
FIG. 7C is a perspective view magnifying a protective cap of the transfer tool.

This preferred embodiment is shown in FIG. 7A to FIG. 7C, which is similar to preferred embodiment 1 except that the basic structure of the transfer tool 1 and structure of the transfer film remover 5 are modified.

That is, the transfer tool 61 of the preferred embodiment is a refill type same as in preferred embodiment 4, and more specifically a case 62 of a slender outline shape incorporates a detachable and exchangeable tape cartridge comprising a payoff reel winding a transfer tape 3 to be paid off, a take-up reel for taking up and collecting the used transfer tape, an interlock mechanism for rotating these two reels mutually in cooperation, a transfer head 4 for pressing and transferring the transfer tape 3 on the transfer area, and a clutch mechanism for synchronizing the payoff speed and take-up speed of the transfer tape 3 between the two reels. In part of the case 2 (at rear end in the illustrated case), a transfer film remover 65 is provided for abrading and removing the transfer film transferred on the sheet of paper.

This transfer film remover 65 has a function as cap holder for detachably holding a protective cap 63. That is, the transfer tool 61 has a protective cap 63 for coating and protecting the transfer head 4, and at the rear end of the case 62, the transfer film remover 65 serving also as cap holder is provided integrally by projecting backward.

The outline shape of the transfer film remover 65 is a nearly truncated conical form specifically as shown in FIG. 7A, and the edge at its leading end forms a corner 65*a* similar to the corner 5*a* in preferred embodiment 1. Near the leading end of the transfer film remover 65, an annular fitting groove 65*b* is provided in the entire periphery to be fitted to an annular fitting rib 63*a* provided at the inner side of the protective cap 63.

The material for the transfer film remover 65 is same as in the transfer film remover 5 in preferred embodiment 1.

The protective cap 63 has a shape and size larger than the internal space of the shape and size of the transfer head 4, and the annular fitting rib 63*a* at the inner side is elastically engaged with an engaging part 66*a* of a head holder 66 provided at the leading end of the case 62.

In the transfer tool 61 having such structure, when correcting a wrong letter, as shown in FIG. 7B, the protective cap 63 of the transfer head 4 is detached, and the transfer tool 61 is manipulated for transfer in a state engaged and held with the transfer film remover 65 at the rear end of the case 2.

On the other hand, when abrading and removing the correction coat film 10 once transferred on the transfer area 11, as shown in FIG. 7A, with the protective cap 63 covered and protective by the transfer head 4, the transfer film remover 65 integrally provided in the case 2 is used. In this case, the case 62 is held in front and rear inverted state of holding in transfer manipulation of correction coat film 10, and nearly same sense of manipulation as in transfer manipulation of the transfer tape 3 is assured. That is, not specifically shown in the drawing, the case 2 is held in front and rear inverted state of holding in transfer manipulation of the correction coat film 10.

The other constitution and action are same as in preferred embodiment 1.

Preferred Embodiment 7

This preferred embodiment is a modified structure of transfer tool 61 in preferred embodiment 6. Specifically, in preferred embodiment 6, the transfer film remover 65 is also used as a cap holder for detachably holding the protective cap 63, but in this preferred embodiment, however, the protective cap 75 itself is formed of transfer film remover. The material for this transfer film remover 75 is same as in the transfer film remover 5 in preferred embodiment 1.

Therefore, the material of the cap holder 76 in this preferred embodiment is not required to satisfy the condition of transfer film remover, and is not particularly limited as far as having a cap protective function.

The other constitution and action are same as in preferred embodiment 6.

Preferred Embodiment 8

Figure 8A:
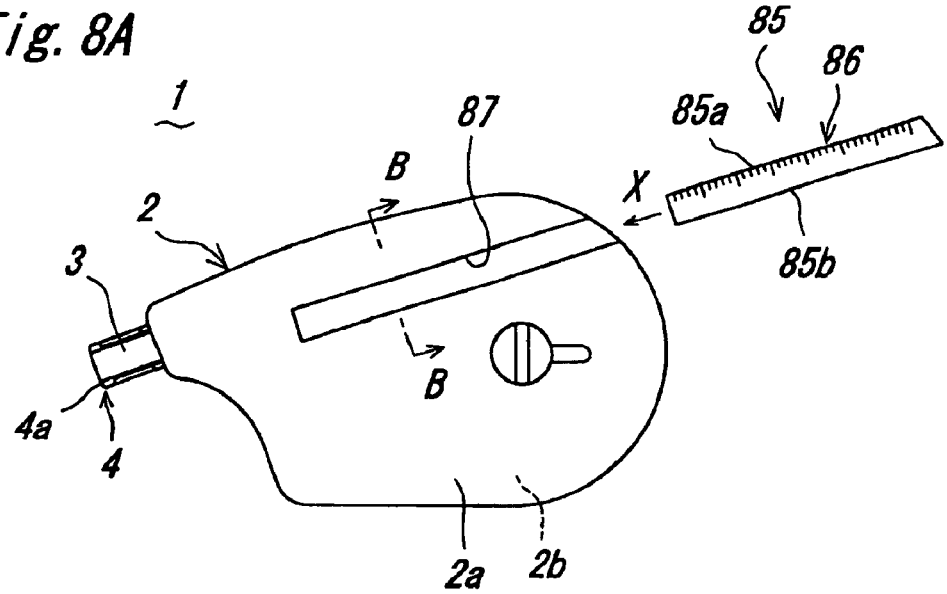
FIG. 8A is a front view showing an entire appearance of transfer tool in preferred embodiment 8 of the invention.
Figure 8B:
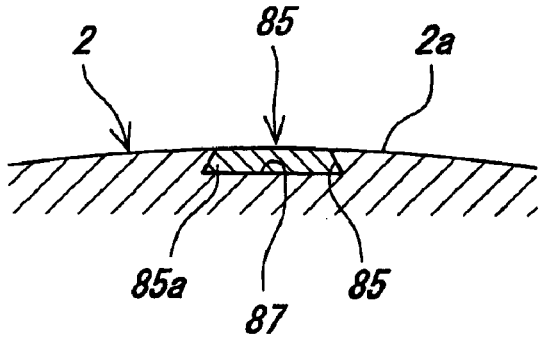
FIG. 8B is a sectional view along line B—B in FIG. 8A showing essential parts of the transfer tool.
Figure 8C:
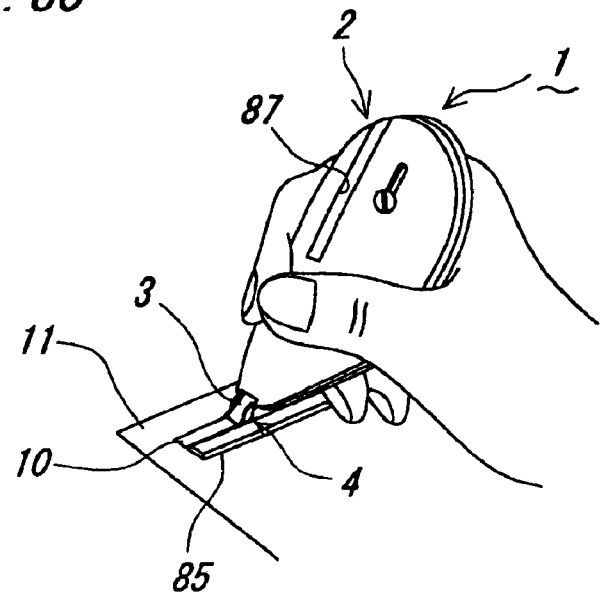
FIG. 8C is a perspective view showing an example of the state of using the transfer tool.

This preferred embodiment is shown in FIG. 8A to FIG. 8C, which is similar to preferred embodiment 1 except that the structure of the transfer film remover 5 is modified.

That is, the transfer film remover 85 of the preferred embodiment is formed like a straightedge detachably provided in part of the case 2. More specifically, the transfer film remover 85 has a slender rectangular form in front view as shown in FIG. 8A, and both side edges 85*a*, 85*b* are flat plates having an inclined section as shown in FIG. 8B, and measurement graduations 86 are provided at one edge 85*a*.

At one side 2*a* of the case 2, there is a dovetail fitting groove 87 corresponding to the sectional shape of the transfer film remover 85, and by sliding and inserting the transfer film remover 85 into this fitting groove 87 in the X-direction in FIG. 8A (in vertical direction to the sheet of paper in FIG. 8B), the transfer film remover 85 is detachably installed in the case 2.

The material for the transfer film remover 85 is same as in the transfer film remover 5 in preferred embodiment 1.

In the transfer tool 1 having such structure, the transfer film remover 85 is always provided in the case 2, and by detaching from the case 2 when required, as shown in FIG. 2A, it is used for the primary purpose of abrading and removing the correction coat film 10 once transferred on the transfer area 11, and it can be also used as a straightedge as shown in FIG. 8C.

Side edges 85*a*, 85*b* of the transfer film remover 85 function as corners of shape and size capable of abrading and removing a small part of the correction coat film 10, and therefore not only the whole correction coat film 10 but also a small part of it can be abraded and removed.

The other constitution and action are same as in preferred embodiment 1.

Preferred Embodiment 9

Figure 9A:
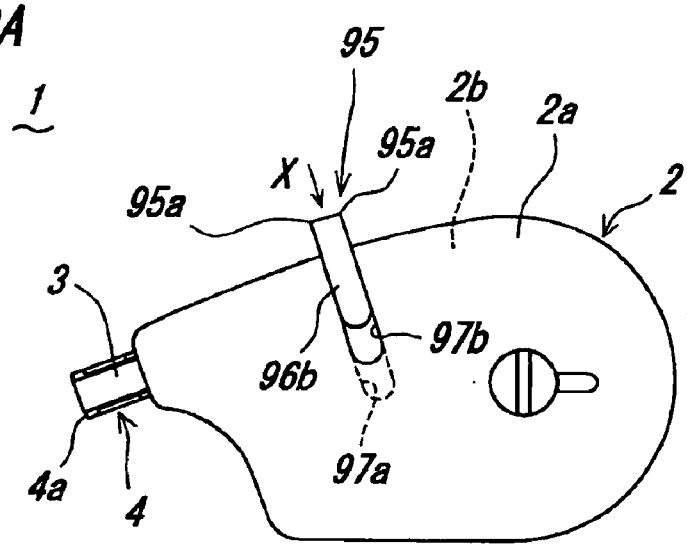
FIG. 9A is a front view showing an entire appearance of transfer tool in preferred embodiment 9 of the invention.
Figure 9B:
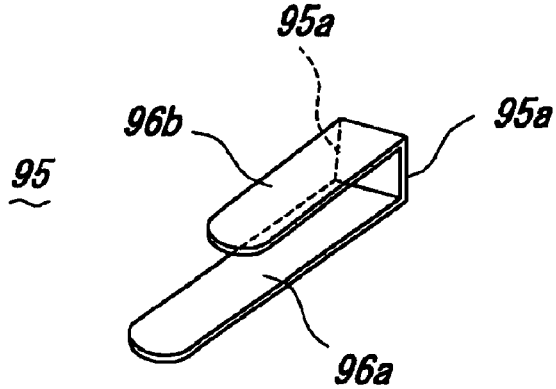
FIG. 9B is a perspective view showing a transfer film remover of the transfer tool.
Figure 9C:
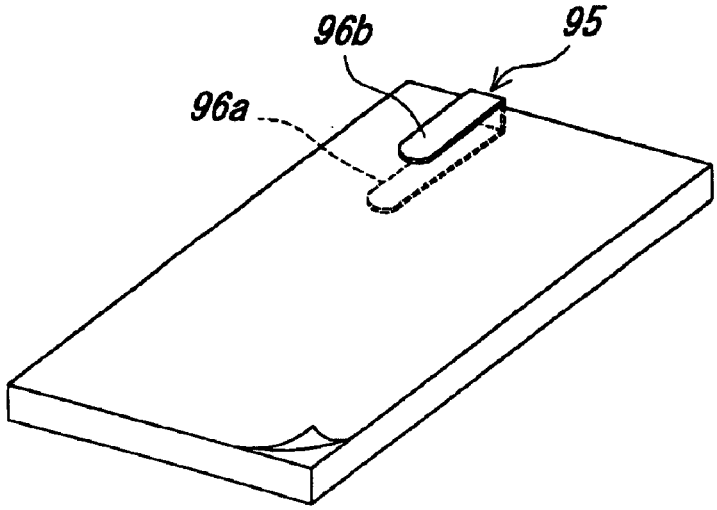
FIG. 9C is a perspective view showing an example of the state of using as holding clip of the transfer film remover.

This preferred embodiment is shown in FIG. 9A to FIG. 9C, which is similar to preferred embodiment 1 except that the structure of the transfer film remover 5 is modified.

That is, the transfer film remover 95 of the preferred embodiment is formed like a flat holding clip detachably provided in part of the case 2. More specifically, the transfer film remover 95 is a pi-shaped thin plate as shown in FIG. 9B, and two elastically deformable parallel holding pieces 96*a*, 96*b* are provided, and one 96*b* is longer than other 96*a*, and the leading ends of the two are formed nearly in semicircular shape.

Both sides 2*a*, 2*b* of the case 2 are provided with fitting grooves 97*a*, 97*b* in shape and size corresponding to the both holding pieces 96*a*, 96*b* of the transfer film remover 95 as shown in FIG. 9A, and by sliding the holding pieces 96*a*, 96*b* of the transfer film remover 95 into these fitting grooves 97*a*, 97*b* in the X-direction in FIG. 9A, and inserting and fixing, the transfer film remover 95 is detachably installed in the case 2.

The material for the transfer film remover 95 is same as in the transfer film remover 5 in preferred embodiment 1.

In the transfer tool 1 having such structure, the transfer film remover 95 is always provided in the case 2, and by detaching from the case 2 when required, as shown in FIG. 2A, it is used for the primary purpose of abrading and removing the correction coat film 10 once transferred on the transfer area 11, and it can be also used as a holding clip for holding documents by clipping as shown in FIG. 9C.

Side edge of the transfer film remover 95 especially side edge 95*a* at the base functions as a corner of shape and size capable of abrading and removing a small part of the correction coat film 10, and therefore not only the whole correction coat film 10 but also a small part of it can be abraded and removed.

The other constitution and action are same as in preferred embodiment 1.

Preferred Embodiment 10

Figure 10A:
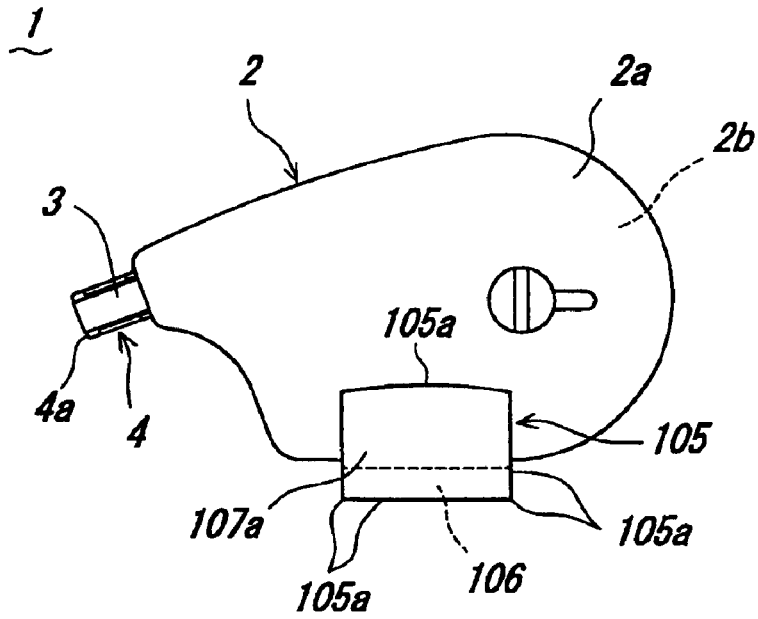
FIG. 10A is a front view showing an entire appearance of transfer tool in preferred embodiment 10 of the invention.
Figure 10B:
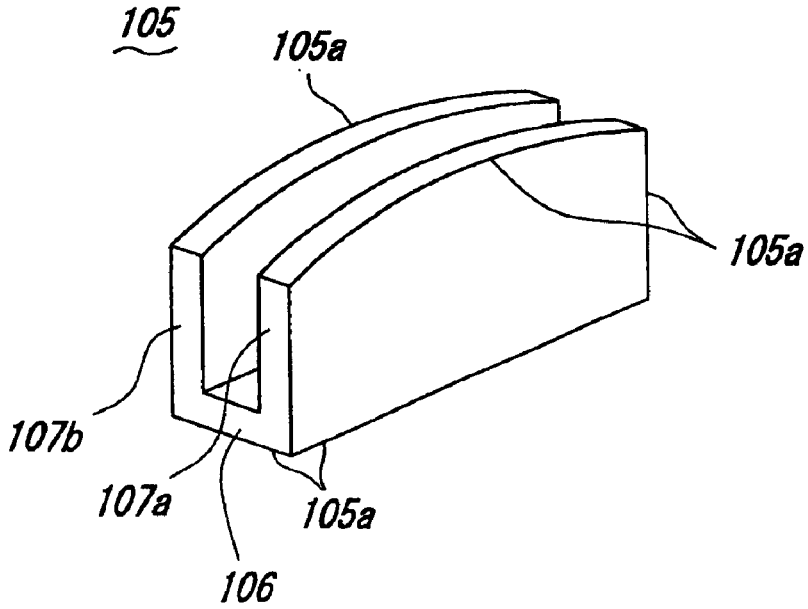
FIG. 10B is a perspective view showing a transfer film remover of the transfer tool.

This preferred embodiment is shown in FIG. 10A and FIG. 10B, which is similar to preferred embodiment 1 except that the structure of the transfer film remover 5 is modified.

That is, the transfer film remover 105 of the preferred embodiment is formed as a case stand detachably provided in part of the case 2. More specifically, the transfer film-remover 105 is a pi-shaped thick plate as shown in FIG. 10B, and two holding pieces 107*a*, 107*b* are formed upright parallel from the both side edges of the base 106, and these holding pieces 107*a*, 107*b* are formed in a same shape with the upper ends formed in an upward arc shape.

The interval of these holding pieces 107*a*, 107*b* is set nearly same as the width between the sides 2*a*, 2*b* of the case 2, and as shown in FIG. 10A, the case 2 of the transfer tool 1 is elastically held between the both holding pieces 107*a*, 107*b* of the transfer film remover 105 mounted on the top of a desk or the like, so as to be held upright on the transfer film remover 105 like a case stand.

The material for the transfer film remover 105 is same as in the transfer film remover 5 in preferred embodiment 1.

In the transfer tool 1 having such structure, the transfer film remover 105 is always provided in the case 2, and by detaching from the case 2 when required, as shown in FIG. 2A, it is used for the primary purpose of abrading and removing the correction coat film 10 once transferred on the transfer area 11, and it can be also used as a case stand for holding the transfer tool 1 upright as shown in FIG. 10A.

Side edges 105*a* of the transfer film remover 105 function as corners of shape and size capable of abrading and removing a small part of the correction coat film 10, and therefore not only the whole correction coat film 10 but also a small part of it can be abraded and removed.

The other constitution and action are same as in preferred embodiment 1.

Successively, the transfer film remover of the invention is more specifically described below by referring to representative examples and comparative examples.

EXAMPLES 1 TO 10

Transfer film removers in the composition shown in Table 1 (examples 1 to 10) were prepared. In the table, the composition shows the percentage of components by weight.

Specifically, as shown in Table 1, using two types of SBS (styrene-butadiene-styrene copolymer) of styrene derivative thermoplastic elastomer as resin component, these materials blended by specified rate were charged between two rolls heated to 120° C., and kneaded sufficiently, and molded into specified shape (for example, circular column), and transfer film removers (examples 1 to o10) were obtained.

EXAMPLES 11 TO 13

Same as in examples 1 to 10, transfer film removers in the composition shown in Table 2 (examples 11 to 13) were prepared. Specifically, as shown in Table 2, using two types of acrylic rubber as rubber component, these materials were blended by specified rate.

EXAMPLES 14 TO 31

Same as in examples 1 to 10, transfer film-removers in the composition shown in Table 3 (examples 14 to 31) were prepared. Specifically, as shown in Table 3, using acrylic rubber as rubber component, and SBS as resin component, these materials were blended by specified rate.

COMPARATIVE EXAMPLES 1 TO 7

Same as in examples 1 to 10, transfer film removers in the composition shown in Table 4 (comparative examples 1 to 7) were prepared. Specifically, as shown in Table 4, a single polyester derivative thermoplastic elastomer was used as resin component.

COMPARATIVE EXAMPLES 8 TO 10

Same as in examples 1 to 10, transfer film removers in the composition shown in Table 5 (comparative examples 8 to 10) were prepared. Specifically, as shown in Table 5, a single polyester derivative thermoplastic elastomer was used as resin component.

TABLE 1

| | Example | | | | | | | | | |
|---|---|---|---|---|---|---|---|---|---|---|
| | 1 | 2 | 3 | 4 | 5 | 6 | 7 | 8 | 9 | 10 |
| SBS A | 75 | 50 | 25 | 75 | 50 | 25 | | | | |
| SBS B | 25 | 50 | 75 | | | | 75 | 50 | 25 | |
| SBS C | | | | 25 | 50 | 75 | 25 | 50 | 75 | |
| SBS D | | | | | | | | | | 70 |
| SBS E | | | | | | | | | | 30 |
| Correction tape | | | | | | | | | | |
| Peel capacity | ○ | ○ | ○ | ◎ | ◎ | ◎ | ◎ | ◎ | ◎ | ◎ |
| Surface scratch | ○ | ○ | ○ | ○ | ○ | ○ | ○ | ○ | ○ | ○ |
| Wear (mg) | 0 | 0 | 0 | 0 | 0 | 0 | 0 | 0 | 0 | 0 |
| Adhesive tape | | | | | | | | | | |
| Peel capacity | ○ | ○ | ○ | ◎ | ◎ | ◎ | ◎ | ◎ | ◎ | ◎ |
| Surface scratch | ○ | ○ | ○ | ○ | ○ | ○ | ○ | ○ | ○ | ○ |
| Wear (mg) | 0 | 0 | 0 | 0 | 0 | 0 | 0 | 0 | 0 | 0 |

TABLE 1-continued

| | Example | | | | | | | | | |
|---|---|---|---|---|---|---|---|---|---|---|
| | 1 | 2 | 3 | 4 | 5 | 6 | 7 | 8 | 9 | 10 |
| Marker tape | | | | | | | | | | |
| Peel capacity | ◎ | ◎ | ◎ | ◎ | ◎ | ◎ | ◎ | ◎ | ◎ | ◎ |
| Surface scratch | ○ | ○ | ○ | ○ | ○ | ○ | ○ | ○ | ○ | ○ |
| Wear (mg) | 0 | 0 | 0 | 0 | 0 | 0 | 0 | 0 | 0 | 0 |

SBS A: Tuffprene A (Asahi Chemicals)
SBS B: Tuffprene 125 (Asahi Chemicals)
SBS C: Tuffprene 126 (Asahi Chemicals)
SBS D: Asaprene T-475 (Asahi Chemicals)
SBS E: Asaprene T-414 (Asahi Chemicals)

TABLE 2

| | | Example | | |
|---|---|---|---|---|
| | | 11 | 12 | 13 |
| | Rubber A | 75 | 50 | 25 |
| | Rubber B | 25 | 50 | 75 |
| Correction tape | Peel capacity | ◎ | ◎ | ◎ |
| | Surface scratch | ○ | ○ | ○ |
| | Wear (mg) | 0 | 0 | 0 |
| Adhesive tape | Peel capacity | ◎ | ◎ | ◎ |
| | Surface scratch | ○ | ○ | ○ |
| | Wear (mg) | 0 | 0 | 0 |
| Marker tape | Peel capacity | ◎ | ◎ | ◎ |
| | Surface scratch | ○ | ○ | ○ |
| | Wear (mg) | 0 | 0 | 0 |

Rubber A: Acrylic rubber SA-NW201 (Kuraray)
Rubber B: Acrylic rubber SA-1000NP (Kuraray)

TABLE 4

| | Comparative example | | | | | | |
|---|---|---|---|---|---|---|---|
| | 1 | 2 | 3 | 4 | 5 | 6 | 7 |
| Polyester A | 100 | | | | | | |
| Polyester B | | 100 | | | | | |
| Polyester C | | | 100 | | | | |
| Polyamide A | | | | 100 | | | |
| Polyamide B | | | | | 100 | | |
| Vinyl chloride A | | | | | | 100 | |
| Vinyl chloride B | | | | | | | 100 |
| Calcium carbonate | | | | | | 130 | 130 |
| Plasticizer | | | | | | 105 | 105 |
| Correction tape | | | | | | | |
| Peel capacity | X | X | X | X | X | X | X |
| Surface scratch | ○ | ○ | ○ | X | X | ○ | ○ |
| Wear (mg) | 0 | 0 | 0 | 0 | 0 | 0 | 0 |
| Adhesive tape | | | | | | | |
| Peel capacity | ○ | ○ | ○ | Δ | Δ | Δ | Δ |
| Surface scratch | ○ | ○ | ○ | ○ | ○ | ○ | ○ |
| Wear (mg) | 0 | 0 | 0 | 0 | 0 | 0 | 0 |
| Marker tape | | | | | | | |
| Peel capacity | ◎ | ◎ | ◎ | ○ | ○ | ◎ | ◎ |
| Surface scratch | ○ | ○ | ○ | ○ | ○ | ○ | ○ |
| Wear (mg) | 0 | 0 | 0 | 0 | 0 | 0 | 0 |

Polyester A: Hitrel #20 (Toray Dupont)
Polyester B: Hitrel #40 (Toray Dupont)
Polyester C: Hitrel #4085 (Toray Dupont)
Polyamide A: Ube Nylon PAE1200U (Ube Industries)
Polyamide B: Ube Nylon PAE1200U2 (Ube Industries)
Vinyl chloride A: ZEST P21 (Shin Daiichi PVC)
Vinyl chloride B: PSH-180 (Kanegafuchi Chemical)
Plasticizer: DOZ (Shin Nihon Rika)

TABLE 3

| | Example | | | | | | | | | | | | | | | | | |
|---|---|---|---|---|---|---|---|---|---|---|---|---|---|---|---|---|---|---|
| | 14 | 15 | 16 | 17 | 18 | 19 | 20 | 21 | 22 | 23 | 24 | 25 | 26 | 27 | 28 | 29 | 30 | 31 |
| Rubber A | 75 | 50 | 25 | 75 | 50 | 25 | 75 | 50 | 25 | | | | | | | | | |
| Rubber B | | | | | | | | | | 75 | 50 | 25 | 75 | 50 | 25 | 75 | 50 | 25 |
| SBS B | 25 | 50 | 75 | | | | | | | 25 | 50 | 75 | | | | | | |
| SBS C | | | | 25 | 50 | 75 | | | | | | | 25 | 50 | 75 | | | |
| SBS D | | | | | | | 25 | 50 | 75 | | | | | | | 25 | 50 | 75 |
| Correction tape | | | | | | | | | | | | | | | | | | |
| Peel capacity | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Surface scratch | ○ | ○ | ○ | ○ | ○ | ○ | ○ | ○ | ○ | ○ | ○ | ○ | ○ | ○ | ○ | ○ | ○ | ○ |
| Wear (mg) | 0 | 0 | 0 | 0 | 0 | 0 | 0 | 0 | 0 | 0 | 0 | 0 | 0 | 0 | 0 | 0 | 0 | 0 |
| Adhesive tape | | | | | | | | | | | | | | | | | | |
| Peel capacity | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Surface scratch | ○ | ○ | ○ | ○ | ○ | ○ | ○ | ○ | ○ | ○ | ○ | ○ | ○ | ○ | ○ | ○ | ○ | ○ |
| Wear (mg) | 0 | 0 | 0 | 0 | 0 | 0 | 0 | 0 | 0 | 0 | 0 | 0 | 0 | 0 | 0 | 0 | 0 | 0 |
| Marker tape | | | | | | | | | | | | | | | | | | |
| Peel capacity | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Surface scratch | ○ | ○ | ○ | ○ | ○ | ○ | ○ | ○ | ○ | ○ | ○ | ○ | ○ | ○ | ○ | ○ | ○ | ○ |
| Wear (mg) | 0 | 0 | 0 | 0 | 0 | 0 | 0 | 0 | 0 | 0 | 0 | 0 | 0 | 0 | 0 | 0 | 0 | 0 |

Rubber A: Acrylic rubber SA-NW201 (Kuraray)
Rubber B: Acrylic rubber SA-1000NP (Kuraray)
SBS B: Tuffprene 125 (Asahi Chemicals)
SBS C: Tuffprene 126 (Asahi Chemicals)
SBS D: Asaprene T-475 (Asahi Chemicals)

TABLE 5

| | | Comparative example | | |
|---|---|---|---|---|
| | | 8 | 9 | 10 |
| High styrene resin | | 100 | | |
| Polyisobutylene | | | 100 | |
| Aqueous hydrocarbon | | | | 100 |
| Correction tape | Peel capacity | Δ | Δ | Δ |
| | Surface scratch | ○ | ○ | ○ |
| | Wear (mg) | 0 | 0 | 0 |
| Adhesive tape | Peel capacity | ◎ | ◎ | X |
| | Surface scratch | ○ | ○ | ○ |
| | Wear (mg) | 0 | 0 | 0 |
| Marker tape | Peel capacity | ◎ | ◎ | X |
| | Surface scratch | ○ | ○ | ○ |
| | Wear (mg) | 0 | 0 | 0 |

High styrene resin: Asaprene 6500 (Asahi Chemicals)
Polyisobutylene: L-100 (Exxon Mobil)
Hydrogenated hydrocarbon: E-5380 (Tonex)

Using these transfer film removers in example 1 to 31 and comparative examples 1 to 10, the transfer film removal tests I to III were conducted, and the peel capacity of transfer film (removal capacity), the surface state of transfer area after removal of transfer film, and the wear amount were measured and evaluated.

Transfer Film Removal Tests I to III

1. Test Piece

The transfer film removers (circular columnar pellet of 10 mm in diameter and about 5.0 mm in length) obtained in example 1 to 31 and comparative examples 1 to 10 were used.

2. Transfer Film Forming Paper (a) Transfer Film Removal Test I

Using a commercial correction tape (coat film transfer tool) (tradename Keshiword IV of Seed Co.), the correction coat film of transfer tape was transferred on sheet of paper (transfer area).

(b) Transfer Film Removal Test II

Using a commercial adhesive tape (coat film transfer tool) (tradename Escal II of Fuji Copian Co.), the adhesive coat film of transfer tape was transferred on sheet of paper (transfer area).

(c) Transfer Film Removal Test III

Using a commercial marker tape (coat film transfer tool) (tradename Pylos of Union Chemical Co.), the marker coat film of transfer tape was transferred on sheet of paper (transfer area).

3. Test Method

A circular columnar test piece was applied in a wear tester, with the circular edge (corner) of the leading end of the test piece kept vertically in contact with the transfer film forming paper, in the condition of load of 500 g applied to the test piece as pressing force to the sheet of paper at reciprocal moving speed of 150±10 cm/min in a direction parallel to the sheet of paper, abrasive removal action was continued until the correction coat film (transfer film) on the transfer film forming paper was peeled off, and the peel capacity (removal capacity: number of reciprocal strokes required to peel the correction coat film) the surface state of the transfer film forming paper after removal of correction coat film, and the wear amount of test piece were measured and evaluated.

These tests were conducted on the transfer film (transfer film forming paper) of three types of tapes (correction tape, adhesive tape, and marker tape), and test results (peel capacity, surface scratch, and wear) are shown in Tables 1 to 5.

4. Test Results (A) Peel Capacity

To evaluate the peel capacity, the number of reciprocal strokes required to peel off the correction coat film was counted, and was evaluated as excellent (◎) if peeled in 1 to 5 strokes, good (○) in 6 to 10 strokes, poor (Δ) in 11 strokes or more, and bad (X) if not peeled.

(a) Transfer Film Removal Test I

Examples 1 to 31 of the invention were all evaluated as good (○) or higher, and there was no practical problem, and in particular examples 4 to 31 are known to have an excellent peel capacity.

On the other hand, comparative examples 1 to 10 were evaluated as poor (Δ) or lower, and there were practical problems.

(b) Transfer Film Removal Test II

Examples 1 to 31 of the invention were all evaluated as excellent (◎) or higher, and there was no practical problem, and an excellent peel capacity was recognized.

On the other hand, comparative examples 1 to 3, 8 and 9 were evaluated as good (○) or higher, but comparative examples 4 to 7 and 10 were evaluated as poor (Δ) or lower, and there were practical problems.

(c) Transfer Film Removal Test III

Examples 1 to 31 of the invention were all evaluated as excellent (◎) or higher, and there was no practical problem, and an excellent peel capacity was recognized.

On the other hand, comparative examples 1 to 9 were evaluated as good (○) or higher, but comparative example 10 was evaluated as bad (X), and there were practical problems.

(B) Surface Scratch

The surface of the transfer film forming paper was observed after removal of correction coat film, and scratch of test piece by abrasive removal action was investigated, and it was evaluated good (○) if no scratch was found, and bad (X) if scratch was found.

(a) Transfer Film Removal Test I

Examples 1 to 31 of the invention were all evaluated as good (○), and paper surface was not scratched, and there was no practical problem.

On the other hand, comparative examples 1 to 3 and 6 to 10 were evaluated as good (○), but comparative examples 4 and 5 were evaluated as bad (X), and paper surface was scratched, and there were practical problems.

(b) Transfer Film Removal Test II

Examples 1 to 31 of the invention were all evaluated as good (○), and paper surface was not scratched, and there was no practical problem. Comparative examples 1 to 10 were also evaluated as good (○)

(c) Transfer Film Removal Test III

Examples 1 to 31 of the invention were all evaluated as good (○), and paper surface was not scratched, and there was no practical problem. Comparative examples 1 to 10 were also evaluated as good (○).

(C) Wear (mg)

To measure the wear amount of test piece, 10 reciprocal strokes of moving action on the correction coat film were applied as one abrasive removal operation, that is, one abrasive removal operation consists of 10 reciprocal strokes required to peel off the correction coat film without practical problem, and the wear amount of test piece was measured by repeating 200 times of abrasive removal operation (statistically, the number of times of abrasive removal operation repeated throughout the life span of the transfer tool; in the disposable type, corresponding to 5000 times of the life of the provided transfer tape, and in the refill type, corresponding to 500 times of 10 transfer tapes provided changeably).

(a) Transfer Film Removal Test I

Examples 0.1 to 31 of the invention were not worn at all (wear amount of 0), and there was no practical problem. Comparative examples 1 to 10 were also 0 in wear amount.

(b) Transfer Film Removal Test II

Examples 1 to 31 of the invention were not worn at all (wear amount of 0) and there was no practical problem. Comparative examples 1 to 10 were also 0 in wear amount.

(c) Transfer Film Removal Test III

Examples 1 to 31 of the invention were not worn at all (wear amount of 0), and there was no practical problem. Comparative examples 1 to 10 were also 0 in wear amount.

The examples are preferred embodiments of the invention, but the invention is not limited to these examples alone, and may be changed and modified in design. Modified examples are given below.

(1) For example, the transfer tool 1 of preferred embodiments 1 to 3 and 8 to 10 relates to a disposable type structure entirely composed of consumable parts including the transfer tape, whereas the transfer-tools 41, 61 of preferred embodiments 4, 6, and 7 relate to a refill type structure partly composed of exchangeable parts including the transfer tape, but the transfer film removers provided in them, that is, 5, 25, 35, 45, 55, 65, 75, 85, 95, and 105 can be converted to the transfer tool of opposite type structure, that is, those in the disposable type structure can be applied in the transfer tool of the refill type structure, and others in the refill type structure can be applied in the transfer tool of the disposable type structure.

(2) The transfer tools 1, 41 and 61 of the preferred embodiments comprise both the payoff reel winding a transfer tape to be paid off, and a take-up reel for taking up and collecting the used transfer tape after being pressed and transferred to the transfer area by the transfer head, both provided in the case, but the transfer film removers 5 to 105 of the invention can be also applied in the transfer tool of a simple structure omitting the take-up reel so that the used transfer tape is cut off and removed without being collected in the case.

(3) Further, the transfer tape 3 can be applied, not only in the correction tape for disposing and holding a correction coat film as shown in the drawings, but also in other transfer tapes such as adhesive tape (adhesive coat film applied peelably on the surface of base tape) and marker taper (marker coat film applied peelably on the surface of base tape) used in the above tests, or mark transfer tape (pressure-sensitive adhesive transfer marks peelably applied-continuously at specific intervals on the surface of base tape).

According to the transfer tool of the invention, since the transfer film remover for abrading and removing the transfer film transferred on the sheet of paper is provided in part of the case, by the exclusive transfer film remover always furnished in the transfer tool, the transfer film once transferred on the transfer area can be abraded and removed, and there is no risk of dropping and losing.

The position of the case comprising the transfer film remover is ergonomically set at a position proper for holding and manipulating by a hand when abrading and removing by pressing this transfer film remover to the transfer film transferred on a sheet of paper or the like, so that the transfer film can be abraded and removed easily and securely.

The transfer film remover has an appearance and shape having a corner of shape and dimension capable of abrading and removing a small part of the transfer film in its part, and therefore not only the whole transfer film but also a small part thereof can be abraded and removed.

The transfer film remover of the invention is composed of a material small in wear when abrading and removing the transfer film transferred on the sheet of paper, and therefore various transfer films once transferred on the sheet of paper by the transfer tool can be abraded and removed easily and securely without scratching or staining the sheet of paper.

Further, since the transfer film remover is composed of a material of small wear, and when it is provided in part of the case of the transfer tool of the invention, it is almost free from wear in the time course as compared with the life span of the transfer tool itself, and the appearance of the transfer tool is not spoiled by wear and deformation of the transfer film remover.

As the invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A transfer tool for transferring a coat film, transfer mark or other transfer film on transfer tape on a sheet of paper, comprising: at least, a hand-held case to be manipulated by one hand, a payoff reel rotatably installed in the case and winding thereon a transfer tape so as to be paid off, and a transfer head disposed at the leading end of the case for pressing and transferring the transfer tape paid off from the payoff reel onto a transfer area, wherein a transfer film remover is provided in part of the case for abrading and removing the transfer film transferred on a sheet of paper.

2. The transfer tool of claim 1, comprising:

said hand-held case to be manipulated by one hand, said payoff reel rotatably installed in the case and winding thereon a transfer tape so as to be paid off, a take-up reel rotatably installed in the case for taking up and collecting the used transfer tape, an interlock mechanism for rotating the take-up reel and payoff reel mutually in cooperation, said transfer head disposed at the leading end of the case for pressing and transferring the transfer tape paid off from the payoff reel onto a transfer area, and a clutch mechanism for synchronizing the payoff speed and take-up speed of the transfer tape between the payoff reel and take-up reel, wherein said transfer film remover is provided in part of the case for abrading and removing the transfer film transferred on a sheet of paper.

3. The transfer tool of claim 1, wherein the position of the case comprising the transfer film remover is ergonomically set at a position proper for holding and manipulating by a hand when abrading and removing by pressing this transfer film remover to the transfer film transferred on a sheet of paper or the like.

4. The transfer tool of claim 1, wherein said transfer film remover is integrally provided in the transfer head projecting from the leading end of the case.

5. The transfer tool of claim 4, wherein said transfer film remover is composed of a constituent material of the transfer head and is formed integrally with the transfer head.

6. The transfer tool of claim 1, wherein said transfer film remover is integrally provided on the surface of the leading end of the case.

7. The transfer tool of claim 1, wherein said transfer film remover is formed as a rewind button for rewinding the transfer tape provided oppositely to the outside of the case.

8. The transfer tool of claim 1, wherein said transfer film remover is formed as a case constituent member for composing part of the case.

9. The transfer tool of claim 8, wherein said case constituent member is detachable from the case.

10. The transfer tool of claim 8, wherein said case constituent member is integrally fixed in the case.

11. The transfer tool of claim 1, wherein said transfer film remover is formed as a transfer film removal seal adhered to the surface of the case.

12. The transfer tool of claim 1, further comprising:

a protective cap for covering and protecting the transfer head, and a cap holder for detachably holding the protective cap in part of the case, wherein said cap holder is composed of the transfer film remover.

13. The transfer tool of claim 1, wherein said transfer film remover is formed as a protective cap for covering and protecting the transfer head.

14. The transfer tool of claim 1, wherein said transfer film remover is detachably provided in part of the case.

15. The transfer tool of claim 14, wherein said transfer film remover is formed as a flat straightedge.

16. The transfer tool of claim 14, wherein said transfer film remover is formed as a flat holding clip.

17. The transfer tool of claim 14, wherein said transfer film remover is formed as a case stand for holding the case upright.

18. The transfer tool of claim 1, wherein said transfer film remover has an appearance and shape having a corner of shape and dimension capable of abrading and removing a small part of the transfer film in its part.

19. The transfer tool of claim 1, wherein said transfer film remover is composed of a material small in wear when abrading and removing the transfer film transferred on the sheet of paper.

20. The transfer tool of claim 19, wherein said transfer film remover is composed of a material not worn substantially at least within the life span of the transfer tool.

21. The transfer tool of claim 20, wherein said transfer film remover is composed of a material not worn substantially at least in 200 times of abrasive removal operations, supposing one abrasive removal operating comprising 10 reciprocal strokes on the transfer film transferred on the sheet of paper.

22. The transfer tool of claim 19, wherein said transfer film remover is composed of a material not changed in surface properties substantially at least within the life span of the transfer tool.

23. The transfer tool of claim 19, wherein said transfer film remover contains at least one of resin component and rubber component.

24. The transfer tool of claim 23, wherein said resin component is thermoplastic elastomer.

25. The transfer tool of claim 24, wherein said thermoplastic elastomer includes at least one of styrene derivative thermoplastic elastomer and olefin derivative elastomer.

26. The transfer tool of claim 25, wherein said styrene derivative thermoplastic elastomer includes at least one of styrene-butadiene-styrene copolymer, styrene-isoprene-styrene copolymer, styrene-ethylene butylene-styrene copolymer, styrene-ethylene propylene-styrene copolymer, and styrene-ethylene ethylene propylene-styrene copolymer.

27. The transfer tool of claim 25, wherein said olefin derivative elastomer includes at least one of olefin derivative thermoplastic elastomer, ethylene-alpha-olefin copolymer, propylene-alpha-olefin copolymer, ethylene-alpha-olefin copolymer (metallocene catalyst), amorphous poly-alpha-olefin, high density polyethylene, low density polyethylene, ultralow density polyethylene, and polypropylene.

28. The transfer tool of claim 23, wherein said rubber component includes at least one of butyl rubber, isoprene rubber, styrene butadiene rubber, butadiene rubber, ethylene propylene rubber, ethylene propylene terpolymer, acrylic rubber, polyisoprene, and natural rubber.

29. The transfer tool of claim 23, wherein said rubber component has a core-shell structure.

30. The transfer tool of any one of claims 23 to 29, wherein said transfer film remover contains the resin component and rubber component, the ratio of resin component and rubber component by weight is set in a range of 25:75 to 75:25.

* * * * *